United States Patent [19]

McKeown et al.

[11] 3,944,313

[45] Mar. 16, 1976

[54] BIFURCATED ELECTRICAL CONTACT

[75] Inventors: James E. McKeown; Donald E. Michel, both of Sidney, N.Y.

[73] Assignee: The Bendix Corporation, Southfield, Mich.

[22] Filed: July 31, 1974

[21] Appl. No.: 493,425

[52] U.S. Cl. ..... 339/75 MP; 339/176 MP

[51] Int. Cl.[2] ..... H01R 13/54

[58] Field of Search ..... 339/17 L, 17 LS, 17 LM, 339/17 M, 75 MP, 91 R, 176 MP, 176 MF, 260, 261

[56] References Cited

UNITED STATES PATENTS

| | | | |
|---|---|---|---|
| 3,140,907 | 7/1964 | Davies | 339/17 L |
| 3,199,066 | 8/1965 | Eledge | 339/176 MP |
| 3,466,591 | 9/1969 | Ecclesia | 339/176 MP |
| 3,725,853 | 4/1973 | McKeown | 339/252 R |

*Primary Examiner*—Joseph H. McGlynn
*Assistant Examiner*—Mark S. Bicks
*Attorney, Agent, or Firm*—Raymond J. Eifler

[57] ABSTRACT

A bifurcated electrical contact having a pair of resiliently deflectable arms having end portions adapted to contact each other. The restorative force of the deflected arms is increased by projections (17) spaced from the end portions (16), which contact each other before the surfaces (19) of the end portions contact each other thereby increasing the restorative force on the arms.

4 Claims, 4 Drawing Figures

BIFURCATED ELECTRICAL CONTACT

CROSS-REFERENCE TO RELATED APPLICATIONS

This application is also related to design application 227,339 entitled "Contact Design" filed Feb. 17, 1972 now U.S. Pat. No. D232,557 issued Aug. 27, 1974.

BACKGROUND OF THE INVENTION

This invention relates to electrical connectors and is more particularly related to a new type of electrical contact.

Presently, printed circuit boards are connected to other electrical circuits by mating plated electrical contacts on the end portion of a printed circuit card with card edge connector contacts. Some of the disadvantages associated with present card edge connectors are poor electrical contact occurs after prolonged use and during shock and vibration testing the contacts on the printed circuit boards come out of the card edge connector causing the circuit board to lose electrical continuity. Further, contacts in the connector tend to build up an oxide on the contact surface over the life of a connector. Attempts to keep the connector contact surface free of oxide by action of the circuit board contact surface against the surface of the connector contact has resulted in excessive wear of both contacts, which results in poor electrical conductivity between the contacts. In instances where the contacts are of the male pin-type contact and the female socket type contact, the inner diameter of the female socket and the outer diameter of the male pin-type contact wear down until the contacts no longer mate together in pressurized contact.

To eliminate the aforementioned disadvantages associated with present printed circuit board type contacts and connectors, a new type of connector was developed that provided bifurcated electrical contacts that, in addition to electrically connecting to conduits in a circuit board, mechanically linked the contacts to the circuit board by mating with the conduits in the circuit board. An example of such an electrical connector and contact is illustrated in U.S. Pat. No. 3,725,853 entitled "Electrical Contact" issued Apr. 3, 1973 to James E. McKeown.

One disadvantage associated with this new connector with bifurcated contacts is that the restorative force on the resiliently deflectable arms, after the arms have been deflected to mate with the conduits in the circuit board, is not always sufficient to allow the arms of the contact to overcome the forces of friction between the conduit and contacts, and allow the arms to return to their original position. Therefore, one problem associated with this type of connector is to provide a means for restoring the deflected arms of a contact to their original position after they have been deflected.

SUMMARY OF THE INVENTION

This invention provides an electrical contact with resiliently deflectable arms, the restorative force of which has been increased by its novel configuration.

The invention is a Y-shaped or bifurcated electrical contact characterized by internal projections (17) which contact each other before the surfaces (19) of the elongated end portions (16) of the resiliently deflectable arms contact each other so as to increase the restorative force acting on the deflected arms.

In one embodiment of the invention, the electrical contact comprises: a shaft (11) having a central axis; a forked end comprised of two arms integrally connected to the shaft and resiliently deflectable towards the central axis, the arms including elongated end portions (16) that extend transverse to the central axis and which are axially aligned with and projecting towards each other, the elongated end portions terminating in angled surface portions (19) that oppose each other in generally face-to-face relationship so that when said arms are deflected towards each other, the angled surface portions (19) contact each other and move the elongated portion (16) out of axial alignment; and a projection (17) integrally connected to each of the arms at a point spaced a predetermined distance from one end of the shaft (11), the projections (17) projecting in a direction transverse to the central axis of the shaft (11) and extending in a direction towards an opposite arm, the projections (17) arranged so as to face each other and come into contact when the arms are deflected towards each other but before the angled surface portions (19) contact each other whereby the restorative force acting on the deflected arms is greater than similar contacts without such projections.

Accordingly, it is an object of this invention to provide a Y-shaped contact having resiliently deflectable arms with projections thereon that contact each other when the arms are deflected to increase the restorative force of the deflected arms.

The above and other objects and features of this invention will become apparent from the following detailed description taken in conjunction with the accompanying drawings and claims which form a part of the specification. Further, the use of numerals is for the purpose of clarification only and is not intended to limit the invention to the specific structure referenced.

DETAILED DESCRIPTION OF THE DRAWINGS

Figure 1:
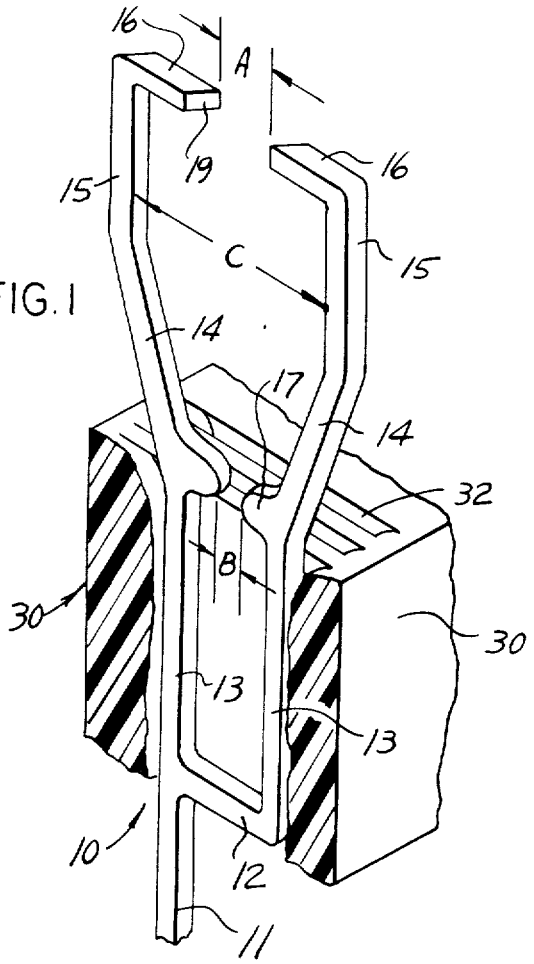
FIG. 1 is a diagrammatic view of an electrical contact incorporating the principles and objects of this invention.

FIG. 1 illustrates the novel electrical contact with its resiliently deflectable arms in their normal position. The electrical contact is a single unitary structure formed from sheet metal and includes a shaft 11 having a central axis and two resiliently deflectable arms integrally connected thereto. Each of the arms includes four portions 13, 14, 15 and 16, and a projection 17, all integrally connected together. The first elongated portion 13 is arranged generally parallel to the central axis of the shaft 11. The second elongated portion 14 has one end attached to the first elongated portion 13 and extends in a direction away from the first member 13 at an angle to the central axis of the shaft 11. At the junction between the first portion 13 and the second portion 14, there is a projection 17 which extends in a direction transverse to the central axis of the shaft 11 and towards the other arm. The third elongated portion 15 has one end attached to the other end of the second elongated portion 14 and extends in a direction away from the shaft 11 and parallel to the central axis of the shaft. Attached to the other end of the third elongated portion 15 is a fourth elongated portion 16 which extends in a direction transverse to the central axis of the shaft and in the direction of the other arm. The fourth elongated portion 16 includes a generally tapered or angled end surface 19 that faces a similarly arranged angled end surface 19 on the other arm.

The arms may be arranged symmetrically about the shaft 11 or, as shown in the preferred embodiment, one of the arms may have its first elongated portion 13 not only parallel to the central axis of the shaft 11 but also coaxial therewith. The other arm then includes an elongated member 12 having one end integrally connected to the shaft 11 and extending in a direction transverse to the central axis of the shaft and the other end integrally connected to one end of the first elongated portion 13.

The contact 10 is shown mounted in a plastic base 30 which includes a plurality of slots 32 which receive respective electrical contacts 10.

The arms of the contact 10 are generally symmetrically arranged so that the angled end surfaces 19 of the fourth elongated end portions 16 are spaced from each other a distance A while the projections 17 on each arm are spaced from each other a distance B which is less than the distance A so that when the arms are deflected towards each other the projections 17 contact each other before the angled end surfaces 19. This arrangement increases the restorative force on the arms when the arms are deflected so that the angled end surfaces 19 contact each other.

Figure 2:
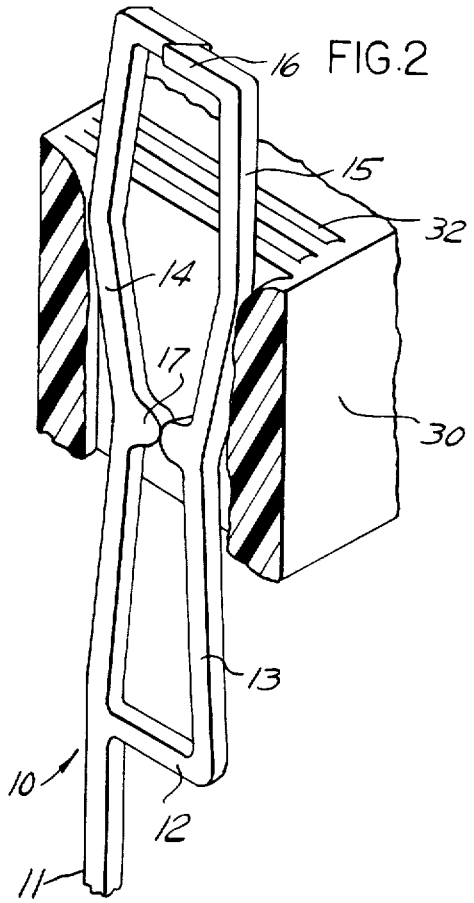
FIG. 2 is a diagrammatic view showing the novel contact with its arms deflected.

FIG. 2 illustrates the contact arms after they have been deflected so that the end surfaces 19 contact each other. This figure illustrates how the projections 17 are also in contact with each other when the arms are deflected to bring the angled end surfaces 19 into contact with each other.

Figure 3:
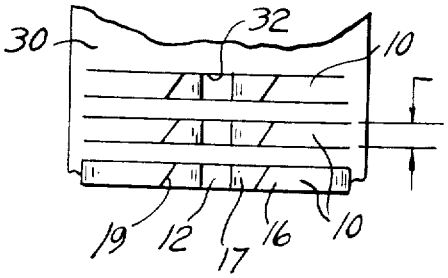
FIG. 3 is a partial diagrammatic end view of the contact.

FIG. 3 is an end view of the contacts 10 which illustrates how a plurality of contacts 10 are disposed in the slots 32 of the plastic member 30. Looking down into the contact 10 it is readily apparent that the angled end surfaces 19 are spaced apart a further distance from each other than are the internal projections 17, thus giving this particular contact the novel feature that increases the restorative force on the contact arms 16 once they have been deflected towards each other.

Figure 4:
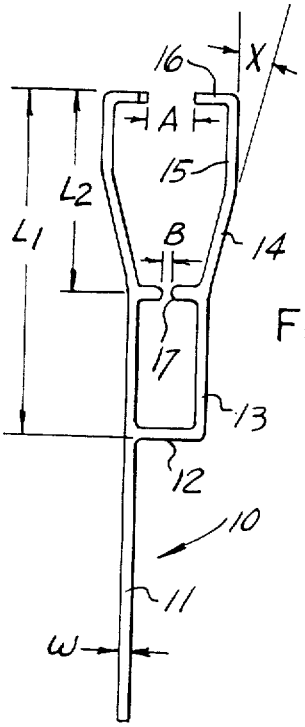
FIG. 4 is a plan view of the electrical contact.

FIG. 4 is a plan view of an electrical contact illustrating the important features of this invention as well as the parameters that the inventors feel are important in obtaining optimum performance from such a contact.

The contact 10 includes a shaft 11 and arms having portions 12, 13, 14, 15, and 16 which have a width w approximately 0.025 inches.

It is the inventors' belief that the following parameters and relationships are the key elements that optimize the functions of this contact:

A: The distance between the end portions of the contacts. (between 0.030 and 0.200 inches, preferably 0.070 inches).

B: The distance between the projections on a contact. (between 0.010 and 0.080 inches, preferably 0.055 inches).

A/B: Greater than 1, preferably less than 3B.

L1: The axial length of a contact arm. (about 0.750 inches).

L2: The axial length from the center of a projection 17 to the end of a contact arm. (about 0.370 inches).

L1/L2: Is greater than 1 but less than 3. Preferably, about 2.

X: The angle that the elongated arm portion 14 makes with the central axis of the shaft 11. (between 10° to 30°, preferably 20°).

*w:* Width of shaft and arms. (about 0.025 inches).

*t:* Thickness of contact. (about 0.0180 inches).

The above preferred parameters and ratios provide an electrical contact that has arms which are easily initially deflected but require additional force for further deflection when the internal projections 17 contact each other and change the effective length of an arm subjected to a deflecting force. When a force is applied to the arms to deflect them towards each other before the internal projections 17 contact each other, the moment-arm is L1; after the internal projections 17 contact each other the moment-arm then becomes L2 changing the force necessary to deflect the contacts further. The restorative force on the arms changes respectively.

OPERATION

Referring now to FIGS. 1 and 2, the electrical contact 10 will operate an electrical connector as follows: When a circuit board (not shown) having a conduit therethrough is located so that the axis of the conduit is axially aligned with the elongated end portion 16 of the contact 10, the contact is mated with the circuit board conduit by deflecting the elongated end portion 16 in the direction of the central axis and into the circuit board conduit. This is accomplished as follows: Plastic member 30 is moved in a direction along the central axis and away from shaft 11 until it contacts elongated portion 14 which is at an angle to the central axis of the shaft 11. As the member 30 moves along elongated portion 14, it deflects elongated portion 14 and causes the projections 17 and the faces 19 on the end portion 16 of the contact to move towards each other. Since the spacing between the projections 17 is less than that of the faces 19, the projections 17 contact each other first. Once the projections contact each other, it requires additional force to bring the faces 19 of the elongated end portion 16 into contact. This additional deflecting force also increases the restorative force of the contact arms. When the contact 10 is closed, the projections 17 and elongated member 16 provide a simply supported beam element between member 16 and projections 17. The geometry of the contact is such that the stiffness is enhanced between the projections 17 and elongated members 16 providing a very stiff member to support the contact force applied to the contact when the contact is closed.

While a preferred embodiment of the invention has been disclosed, it will be apparent to those skilled in the art that changes may be made to the invention as set forth in the appended claims and, in some instances, certain features of the invention may be used to advantage without corresponding use of other features. For example, a contact 10 may have a projection 17 on only one arm which is spaced from an opposite arm and adapted to contact that opposite arm so as to change the moment-arm associated with the contact. In such an instance, the ratio A/B should still be greater than 1 wherein B is the distance from the end of the single projection to the opposite arm. Accordingly, it is intended that the illustrative and descriptive materials herein be used to illustrate the principles of the invention and not to limit the scope thereof.

Having described the invention, what is claimed is:

1. An electrical contact formed from sheet metal into single unitary structure, said contact comprising:

a shaft having a central axis, a forward end, a rear end;

a first elongated member integrally connected to said shaft and extending transverse to the central axis of said shaft; and a pair of resiliently deflectable arms arranged in spaced relationship about said central axis, said arms including:

a first elongated portion having one end integrally connected to said first elongated member, said first elongated portion extending in a direction away from said shaft and first member and parallel to the central axis of said shaft;

a second elongated portion having one end integrally connected to the other end of said first elongated portion, said second elongated portion extending in a direction away from said first member and at an angle to the central axis of said shaft;

a third elongated portion having one end integrally connected to the other end of said second elongated portion, said third elongated portion extending in a direction away from said shaft and first member and parallel to the central axis of said shaft; and a fourth elongated portion having one end integrally connected to the other end of said third elongated portion, said fourth elongated portion extending in a direction transverse to the central axis of said shaft, the fourth elongated portion of each arm arranged so that the other ends of each fourth elongated portion face each other; and a first projection located at the junction between the first and second elongated portions of one of said arms and extending towards said other arm.

2. The electrical contact as recited in claim 1 including:

a second projection on said other arm, said second projection located at the junction between the first and second elongated portions of said other arm and facing said first projection.

3. An electrical contact as recited in claim 2 wherein said projections are spaced apart from each other a distance B and said other ends of said fourth elongated portions are spaced apart from each other a distance A and wherein the distance A is greater than distance B.

4. The electrical contact as recited in claim 3 wherein a cross-section taken transverse to the longitudinal axis of said elongated portions is generally square-shaped.

* * * * *